US006666676B2

(12) United States Patent
Rodriguez-Rodriguez et al.

(10) Patent No.: US 6,666,676 B2
(45) Date of Patent: Dec. 23, 2003

(54) PROGRAMMABLE BURNER FOR GAS STOVES

(75) Inventors: Jorge Rodriguez-Rodriguez, San Luis Potosí (MX); David H. Fredin Garcia, San Luis Potosí (MX)

(73) Assignee: Comercial Acros Whirlpool S.A. De C.V. (MX)

( * ) Notice: Subject to any disclaimer, the term of this patent is extended or adjusted under 35 U.S.C. 154(b) by 0 days.

(21) Appl. No.: 09/930,852

(22) Filed: Aug. 15, 2001

(65) Prior Publication Data

US 2002/0094498 A1 Jul. 18, 2002

(30) Foreign Application Priority Data

Aug. 17, 2000 (MX) ..... 008016

(51) Int. Cl.[7] ..... F23N 5/20

(52) U.S. Cl. ..... 431/67; 431/73; 431/75; 431/45; 431/24

(58) Field of Search ..... 431/18, 24, 26, 431/43, 75, 77, 67, 72, 73, 74, 46, 47, 45, 25

(56) References Cited

U.S. PATENT DOCUMENTS

| | | | | | |
|---|---|---|---|---|---|
| 3,914,092 | A | | 10/1975 | Matthews | 431/66 |
| 3,986,813 | A | | 10/1976 | Hewitt | 431/46 |
| 4,055,164 | A | | 10/1977 | Wu-Heng | 431/46 |
| 4,082,493 | A | | 4/1978 | Dahlgren | 431/25 |
| 4,110,065 | A | * | 8/1978 | Fujiwara | 431/47 |
| 4,111,639 | A | | 9/1978 | Matthews | 431/26 |
| 4,190,414 | A | * | 2/1980 | Elmy | 431/67 |
| 4,194,875 | A | | 3/1980 | Hewitt | 431/45 |
| 4,318,687 | A | | 3/1982 | Inoue | 431/78 |
| 4,830,602 | A | | 5/1989 | Kaselow | 431/80 |
| 4,925,386 | A | * | 5/1990 | Donnelly et al. | 431/18 |
| 5,094,259 | A | | 3/1992 | Hsu | 137/66 |
| 5,575,638 | A | * | 11/1996 | Witham et al. | 431/73 |
| 5,722,823 | A | * | 3/1998 | Hodgkiss | 431/43 |
| 5,813,394 | A | * | 9/1998 | Clifford | 431/78 |

FOREIGN PATENT DOCUMENTS

| | | | |
|---|---|---|---|
| JP | 7-190348 - A | * | 7/1995 |
| JP | 8-219453 - A | * | 8/1996 |

* cited by examiner

*Primary Examiner*—Henry Bennett
*Assistant Examiner*—Josiah C. Cocks
(74) *Attorney, Agent, or Firm*—McGarry Bair PC

(57) ABSTRACT

A programmable burner for gas stoves, which is constituted by a gas burner and a safety valve that includes a thermocouple, which is located in coincidence with an external edge of the burner. The safety valve is maintained open when the thermocouple is detecting the presence of a flame on the gas burner and is closed when the burner has been turned off. An electrode is placed near of the external periphery of the burner for igniting. A spark generation module is connected with the electrode for generating the sparks for igniting the burner. A spark interrupter is connected to the spark generation module, the spark interrupter being located over a burner knob that is connected to the safety valve, for activating or deactivating the spark generation of the spark generation module. Finally a programmable device is connected with the thermocouple and the security valve, for programming the ignition time of the burner in accordance with a preestablished operation time by user.

6 Claims, 6 Drawing Sheets

PROGRAMMABLE BURNER FOR GAS STOVES

FIELD OF INVENTION

The present invention is referred to a programmable gas burner for gas stoves, and more particularly to a burner for gas stoves which is possible to program in accordance with to a pre-established operation time chosen by the user.

BACKGROUND OF THE INVENTION

The typical system to ignite oven burners of stoves that use gas mainly includes to partially turn on a gas valve to leave gas through a pilot burner and to ignite the pilot burner manually with a lighted match or by means or a manual electric igniter. Once the pilot burner is ignited, the gas valve is completely open in order to ignite the burner of the oven.

However, one of the main problems of the typical system is that, sometimes, the main burner does not ignite, whether the pilot burner is turned off at the moment that the burner is ignited or by air flows, which results in an accumulation of gas in that area, and this could cause the user to immediately close the valve. In this manner, once the user would try again to light the oven, he would have ventilate the area so as to disperse the gas that might have accumulated, thus preventing a possible explosion.

At the present, there are some ignition systems for the ignition of gas burners that use an electronic ignition system. For example, U.S. Pat. No. 3,914,092 assigned to Johnson Service Controls it is referred to a direct spark ignition system for generating ignition sparks for igniting fuel discharged by a fuel outlet.

Another system for controlling a pilot burner and main gas valves of gas furnace is shown in U.S. Pat. No. 3,986,813 assigned to the Cam-Stat Incorporated company, including a pilot spark igniter and a pilot flame sensor. This system includes a relay having a first standby mode providing power to a spark igniting circuit so that, when the thermostat switch is closed, a pilot valve solenoid is energized, and in a second operating mode disconnecting power from the power from the spark ignition circuit and providing power to the main valve solenoid when the flame is sensed at the pilot burner. The system is provided with a fast responding circuit for operating the relay utilizing a 24 volts supply, with a 48 volts supply provided only for the flame sensor.

Other arrangements of gas burners that already use electronic ignition systems to operate are described and claimed in U.S. Pat. Nos. 4,055,164, 4,082,493, 4,111,639 and 4,194,875, all of them related to control systems for the automatic ignition of the burners. However, in all the cases, these are referred for controlling the pilot and the main burner gas valves (U.S. Pat. Nos. 4,082,493 and 4,194,875); for controlling the ignition of an auxiliary fire nozzle and a main fire nozzle in a water heater (U.S. Pat. No. 4,055,164); or to a self-checking fuel ignition system, which effects periodic testing of the operability of the spark-generation circuit.

Taking into account the previous art, the present invention refers to a programmable burner for gas stoves, which can be programmed in keeping with operation times established by the user. Under this scheme, there already are some systems that were developed and are related to systems used to control gas burners, for example, the U.S. Pat. No. 4,318,687 assigned to the Inoue-Japax Research Incorporated company is claiming a burner system of the type in which a thermocouple or like EMF-generating sensor detects the presence of a pilot flame and controls a main fuel valve to hold the latter open as long as the pilot flame remains lit. According to the invention, the main valve is held open by a solenoid and a resistor is provided in circuit between the sensor and the solenoid to reduce the response time of the latter which results from the inductance contributed by the magnetic coil forming the solenoid.

Another development that is related to gas stoves is described in U.S. Pat. No. 4,830,602, assigned to Cramer GmbH, which is related to a gas range with at least one burner covered by a glass ceramic plate, wherein the burner has a gas cock and a timed-ignition and monitoring device, such that the output of the burners is adjustable. A gas cock is used with plugs rotatable between a high and a low position with the aid of a knob and a knob shaft, with a spindle connected to the knob shaft, with a valve plate under the gas inlet opening in the plug housing, with a microswitch for the ignition device and with the use of an electromagnet under the valve plate, in the area of the gas supply connection of the further housing. The knob with the knob handle and the spindle is pressable against the action of a return spring in the high position of the plug. This way, the microswitch for the timed ignition device becomes actuatable and the valve plate becomes pressable on the electromagnet against the action of a return spring, thereby opening the combustion gas inlet opening. The monitoring device has thermoelement reaching deeply into the flame of the burner, which generates a thermal current after maximum 10 sec., feeding the electromagnet and holding the valve plate. The design of the thermoelement and of the electromagnet are such that the electromagnet releases the valve plate and interrupts the gas supply when the flame of the burner is interrupted for up to 60 seconds or for more than 60 seconds.

Finally, U.S. Pat. No. 5,094,259, assigned to Chung-Hsiung Hsu, refers to an automatic shut-off device for a gas stove, and more particularly, a safety valve control device that can be retrofitted between the gas inlet pipe and the catch base of the stove. The device includes a coupling such that operation of the knob of the gas stove at the time operates the circuit of a gas safety valve control device. This operation causes the forward movement of a function shaft of the gas safety valve device and opens the gas intake valve to supply the gas to the stove burner. The function shaft is also subject to the control by an electromagnetic control rod to maintain the open state of the gas intake valve. In case the fire goes out accidently, the circuit device energizes an electromagnetic coil to attract upwardly an electromagnetic control rod, thereby disconnecting the function shaft, which is spring loaded, and which in turn operates the gas intake valve. This action thus disconnects the gas supply to the stove. Also, if the cooking time is too long, and the fire does not go out (e.g., one forgets to turn off the gas) or the gas at the stove burner can not be ignited within the given time, the device will also shut off automatically the gas intake valve.

SUMMARY OF THE INVENTION

As can been seen from the above, the previously described devices are related with safety devices that automatically close the valve of a gas stove and maintain the valve open through the use of an electric magnet that maintains the seal of an opening/closure retracted by means of a current that is provided by a the stated electromagnet's thermocouple.

However, none of the devices is related with a programmable burner wherein the user could establish a predetermined operation time. The programmable burner of the present invention includes an arrangement formed by a safety valve, a thermocouple located in conjunction with the external edge of the burner. Said safety valve is maintained open by the detection of the presence of a flame on the gas burner. An electrode is placed close to and in conjunction with the burner for igniting. A spark generation module is connected to the electrode that generates the sparks that are necessary for igniting the burner. A spark interrupter is connected to the spark generation module, with the spark interrupter placed over the burner knob that is connected to the safety valve, which, at the moment of igniting the stove's burner, activates the spark generation module, generating the sparks that are necessary for igniting the burner. A clock that includes a time-measuring function in a regressive countdown, is connected to the thermocouple and to the safety valve in order to program the igniting time of the burner with a pre-programmed time; and an interrupter connected to the clock, the safety valve and the thermocouple in order to permit the burner to function for a programmed time or continuously as a normal burner, without having to program an operation time.

OBJECTIVES OF THE INVENTION

Therefore, a first objective of the present invention is to provide a programmable burner for gas stoves through which the user can establish the burner's operation time under a pre-determined period of time.

An additional objective of the present invention is to provide a programmable burner for gas stoves that uses a clock that includes a time-measuring function in a regressive time countdown (chronometer) and a safety valve that is maintained open through a thermocouple.

An additional objective of the present invention is to provide a programmable burner for gas stoves that permits the function of a burner for a programmed time or continuously as a normal burner, without having to program its operation time.

These and other objectives and additional advantages of the present invention will become evident to those who are experts in the field in the following detailed description of the invention, which will be made with reference to a specific embodiment in an illustrative but not limiting manner for said invention.

DETAILED DESCRIPTION OF THE INVENTION

Figure 1:
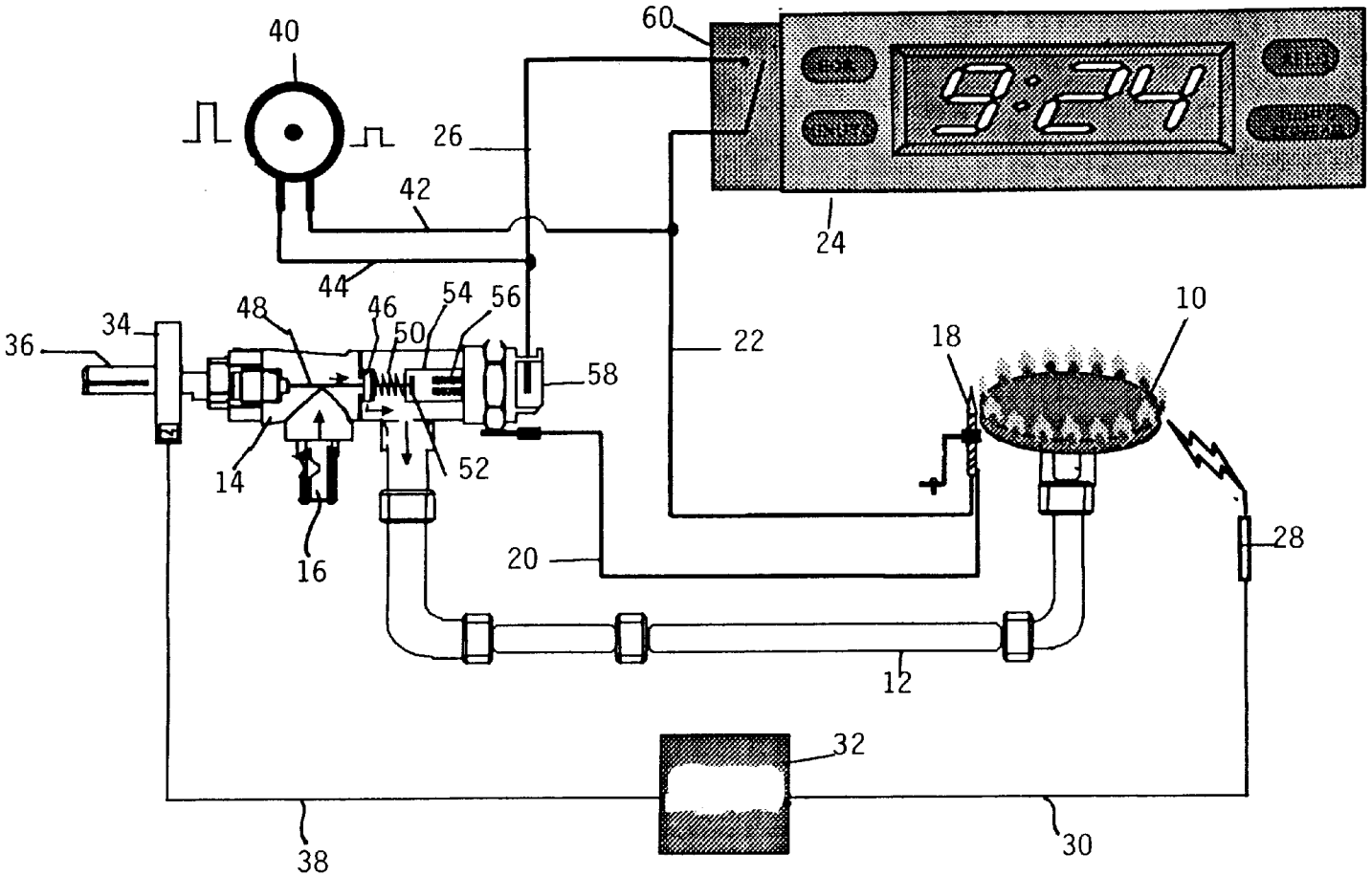
FIG. 1 shows a schematic drawing of the programmable burner arrangement for gas stoves, in accordance with the present invention.

Now making particular reference to FIG. 1, a description of the gas stove programmable burner that includes the following parts: a burner 10, that has a gas-feeding pipe 12, that is connected by its lower part, to supply the gas that is necessary for igniting it. A first end of the feeding pipe 12, is connected to a safety valve 14, to permit or prevent the flow of gas towards the burner 10, its second end of said feeding pipe 12, is connected to the burner 10. The valve 14, includes, additionally a gas entry 16, which itself is connected to a distribution pipe of a gas stove (not shown). A thermocouple 18, is placed in coincidence with the external edge of burner 10, which remains inside the flame of the burner 10, when the latter is ignited. The thermocouple 18, is connected by a first line 20, of the safety valve 14, and by a second line 22, that is connected to a clock 24, that is used for programming the ignition time of the burner 10, with a pre-established time determined by the user. The circuit is closed when the clock 24 is connected with a safety valve 14 by means a third line 26. An electrode 28, is placed nearby and in coincidence with the burner 10, for its ignition, which itself is connected by means of a fourth line 30, to a spark generation module 32, and thus generates the sparks that are necessary for igniting the burner. A spark interrupter 34, is coupled to a shaft 36, of the safety valve 14, that is used to activate the spark generation module 32, during the ignition of the burner 10, of the stove (not shown), thus generating the sparks that are necessary for igniting said burner 10. The sparks interrupter 34, is connected by means of a fifth line 38, to the spark generation module 32.

An interrupter 40, is connected in parallel through a sixth line 42, and a seventh line 44, to lines 22 and 26 of the clock 24, to permit during its open position, that the burner 10, may function under a programmed time or so that, in its closed position, the burner 10, may function in a continuous manner as a normal burner.

Even though the valve 14, is included within the total context of the present invention, this valve 14, is of a commercial type, and it will be described only to obtain a greater comprehension of the programmable burner of the present invention. The valve 14, includes a safety system at its exit, which prevents the flow of gas from the gas feed pipe 12, to the burner 10, by means of a seal 46, that makes contact with the shaft 48, of the valve 14, on the one side of the seal 46, and on the other side of it, installed in a counter position, is found a spring 50, that keeps it obstructing the gas flow.

In order to igniting the burner 10, the shaft 48, is pushed towards the valve 14, turning it to the left in order to adjust the height of the flame that is desired. At the same time, the shaft 48, pushes the seal 46, which will keep the orifice closed, permitting the flow of the gas feeding pipe 12, to the burner 10. At the moment that the shaft 48, of the valve 14, is turned on, the spark interrupter 34, closes and the spark generation module 32, is energized to generate sparks which are delivered by means of a spark plug 28, towards the burner 10, thus igniting the burner 10, so as to normalize the flame.

So, when the seal 46 of the valve 14 is pushed by the shaft 48 of the valve 14, the seal 46, pushes a metallic disc 42, through a pivot. The disc 42, is found on the other end of the pivot, and it is thus taken up to an electric magnet 54, which includes a solenoid 56, that is energized by the thermocouple 18, that generates electric current when it is immersed in the flame of the burner 10. In this manner the electro magnet 54, generates a magnetic field, which holds a metallic disc 52, thus maintaining the pressure seal 46, in the retracted position, thus permitting the flow of gas towards the burner 10. For the seal 46, to be maintained in its open position, it is necessary that the thermocouple's signal 18, be completely established so as to energize the solenoid 56, with sufficient current in order to hold the metallic disc 52 in place. In order to do this, it is necessary to wait from 3 to 5 seconds, pushing the shaft 48 of the valve 14, until the seal 46, is completely held in its retracted position.

The thermocouple 18, that is connected to the connector 58, of the solenoid 56, of the valve 14, by means of the conductors 20, but interrupting the conductor 22, by means of a relay 60, which interrupts the signal of the thermocouple 18, when the programmed time of the clock 24, ends. In this manner, the operation time of the burner 10 is controlled, since that the signal of the thermocouple 18 is interrupted and the safety valve 14 is closed by means of spring 50, over the seal 46.

The relay 60, is normally found open, so that upon programming the time of operation the relay 60, closes, thus permitting the ignition of burner 10. When the programmed time ends, the relay 60, opens, preventing the transfer of current to the thermocouple 18, to the solenoid 56, of the valve 14, thus closing the gas flow. After the supply of gas to the gas burner 10, has been disconnected, the shaft 48 of the valve 14, will have to return to its closed position in order to leave it ready for another operation.

The interrupter 40, will permit the burner 10, to be utilized with programmed time or as a burner that functions continuously as any other non-programmable burner that can be ignited at any moment when opening the valve 14. Thus, when interrupter 40, is closed, the burner 10, functions as a burner without any time of operation (it operates at any time without the need to program its operation time) and, when the interrupter 40, is open, the burner 10, functions as a programmable burner during its time of operation.

Figure 2:
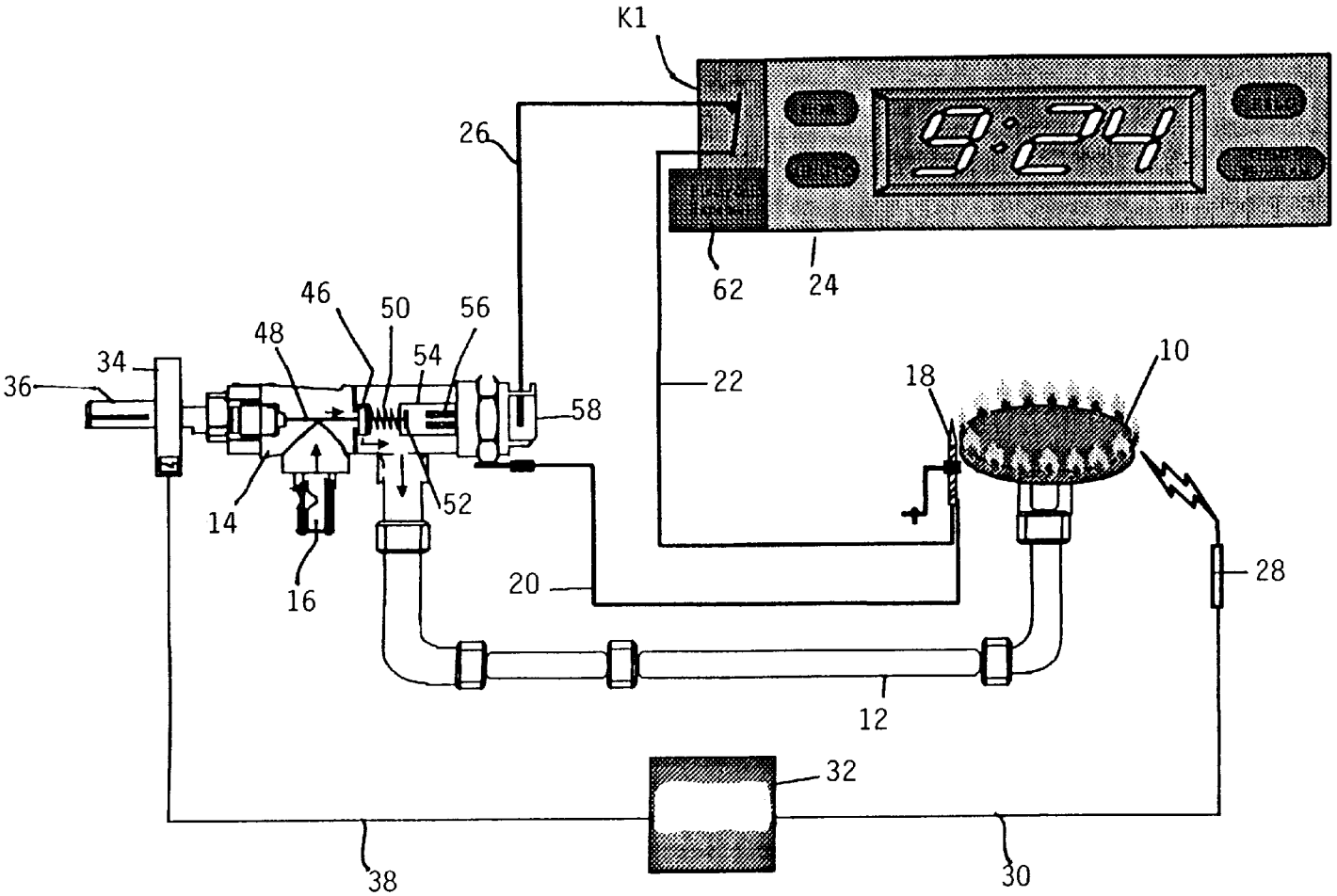
FIG. 2 shows a second embodiment of the programmable burner for gas stoves.

Now making a particular reference to FIG. 2, a second embodiment of the present invention is presented, wherein the interrupter 40, is eliminated, and a relay K1, is maintained, and this relay is normally closed and includes an electronic circuit 62, that is connected to said relay K1.

The use of a normally closed relay K1, permits the operation of the burner 10, with or without programmed time i.e., the burner 10, can be operated in a continuous form without any limitation of time, or it can be operated with a programmed time of operation so that it disconnects the circuit of the thermocouple signal 18, at the end of the period of the programmed function.

In this manner the electronic circuit 62, once the programmed time has ended, generates a pulse which opens the relay K1, thus preventing the passing of the current to the thermocouple 18, to the solenoid 56, of the valve 14, this manner the seal 46, is freed and consequently closes the gas flow to the burner 10. The disconnecting of the current to the thermocouple 18, by means of the relay K1, is for a short time, long enough to liberate the seal 46, and leave the relay K1 closed again, which permits again the re-operation of the burner 10.

Figure 3:
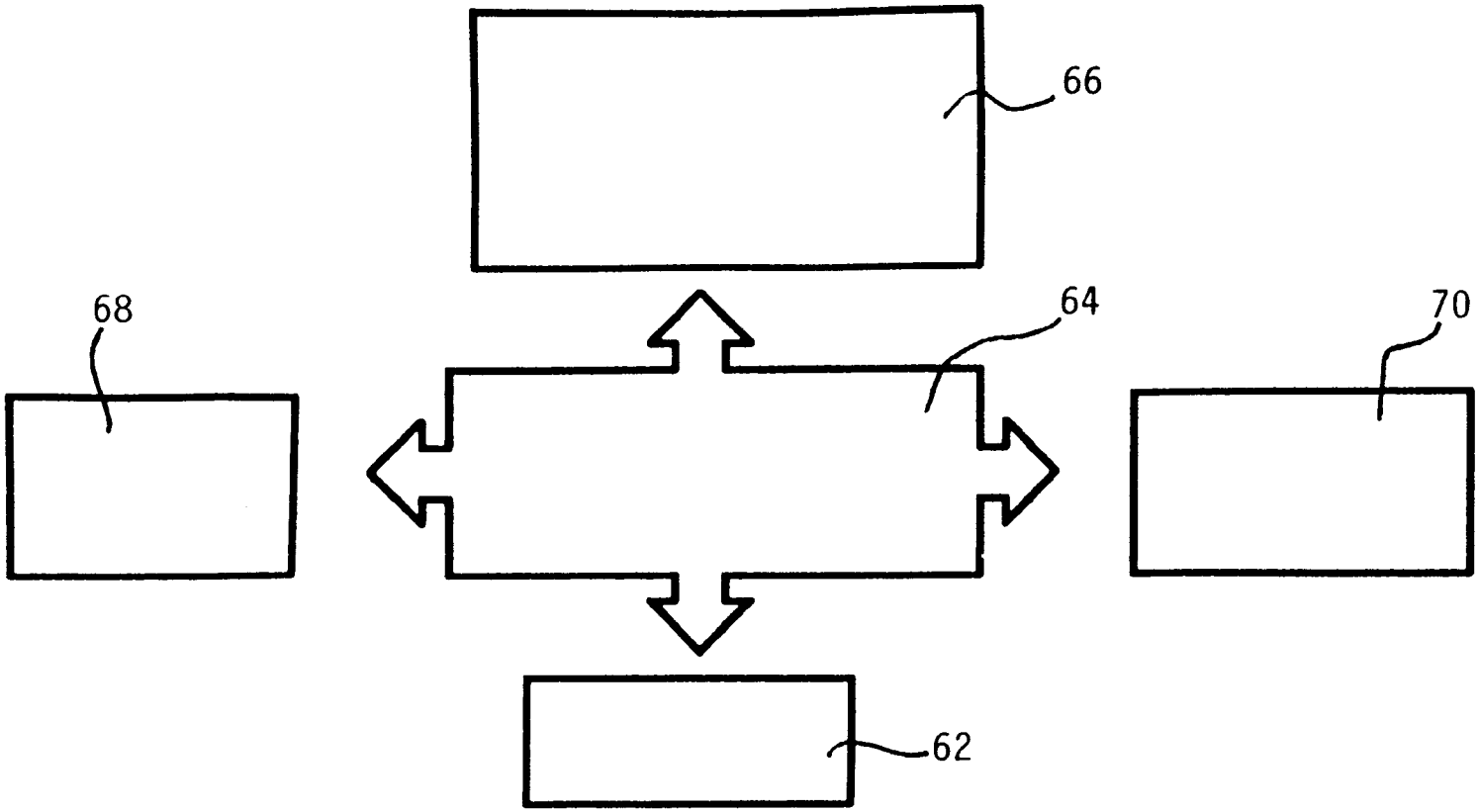
FIG. 3 shows a block diagram of the electronic clock for programming the programmable burner of the present invention.

FIG. 3 shows to the clock 24 represented in a block diagram, which includes a controller 64, a numbers display 66, a keyboard for programming the micro display 68, a buzzer 70, for indicating the termination of the programmed time and an electronic circuit 62, for operating the burner 10, at any moment (without programming it for time), or programming the time to provide an operation period of the burner 10. An important function of the electronic circuit 62, is when the voltage supply of the clock 24, is disconnected, the electronic circuit 62 generates the signal that is necessary for opening the relay K1, and in this manner turns off the burner 10, and prevents an erroneous time programming due to a voltage supply failure.

Figure 4:
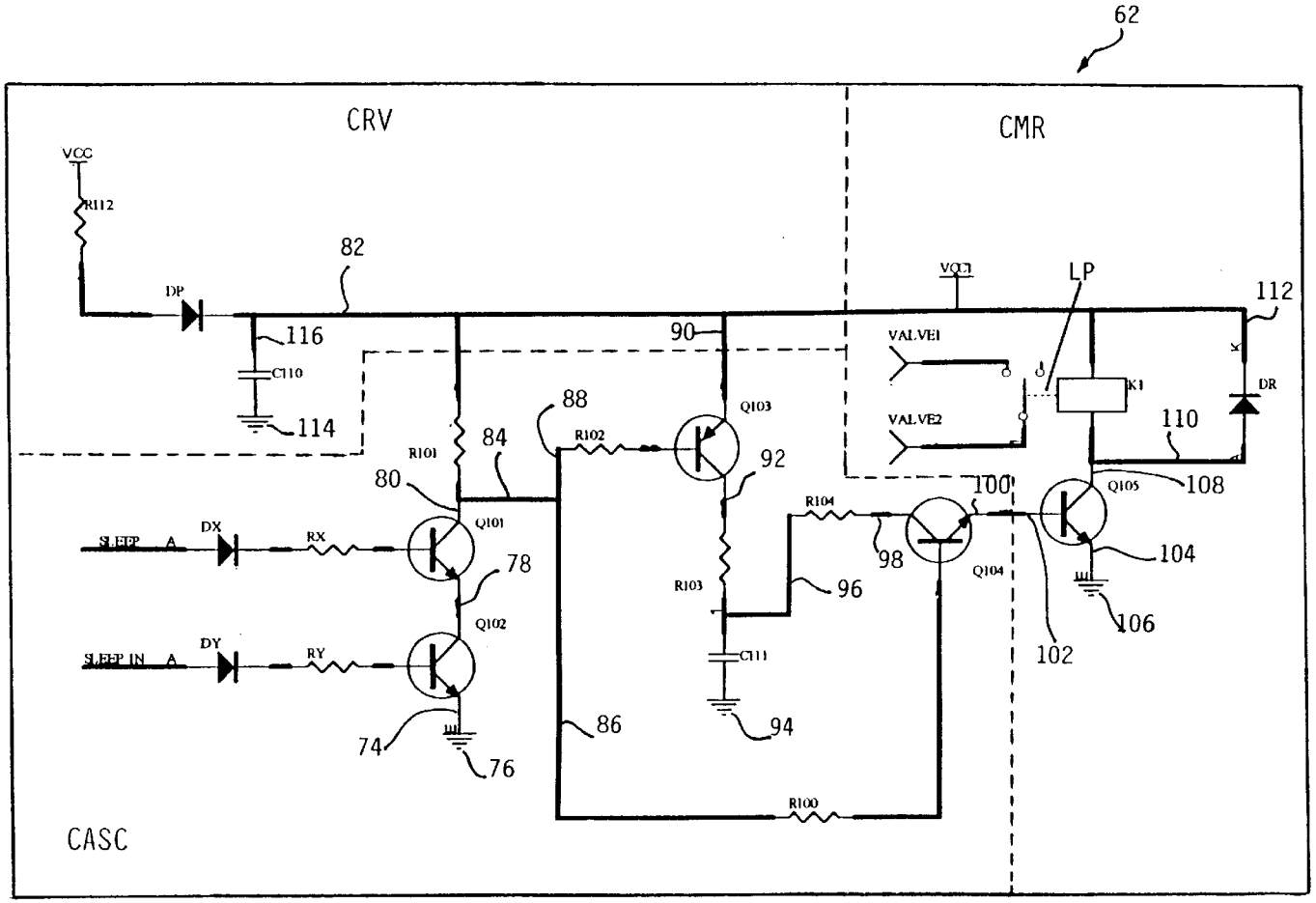
FIG. 4 is an electric diagram that shows a first embodiment of the circuit used to program the burner of the present invention.
Figure 5:
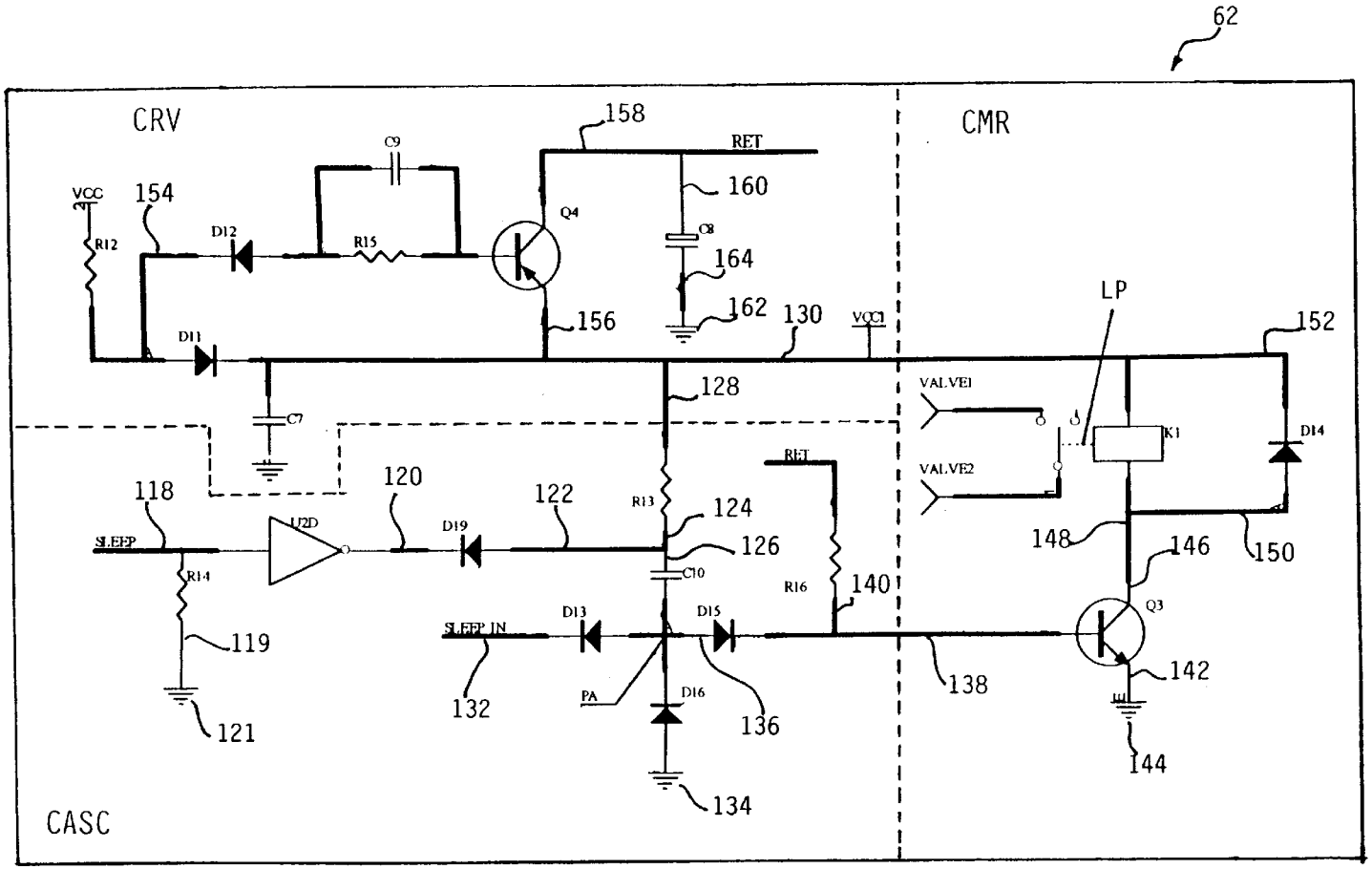
FIG. 5 shows an electric diagram showing a second embodiment of the circuit for programming the burner of the present invention; and, FIG. 6 is an electric diagram showing a third embodiment of the circuit for programming the burner of the present invention.
Figure 6:
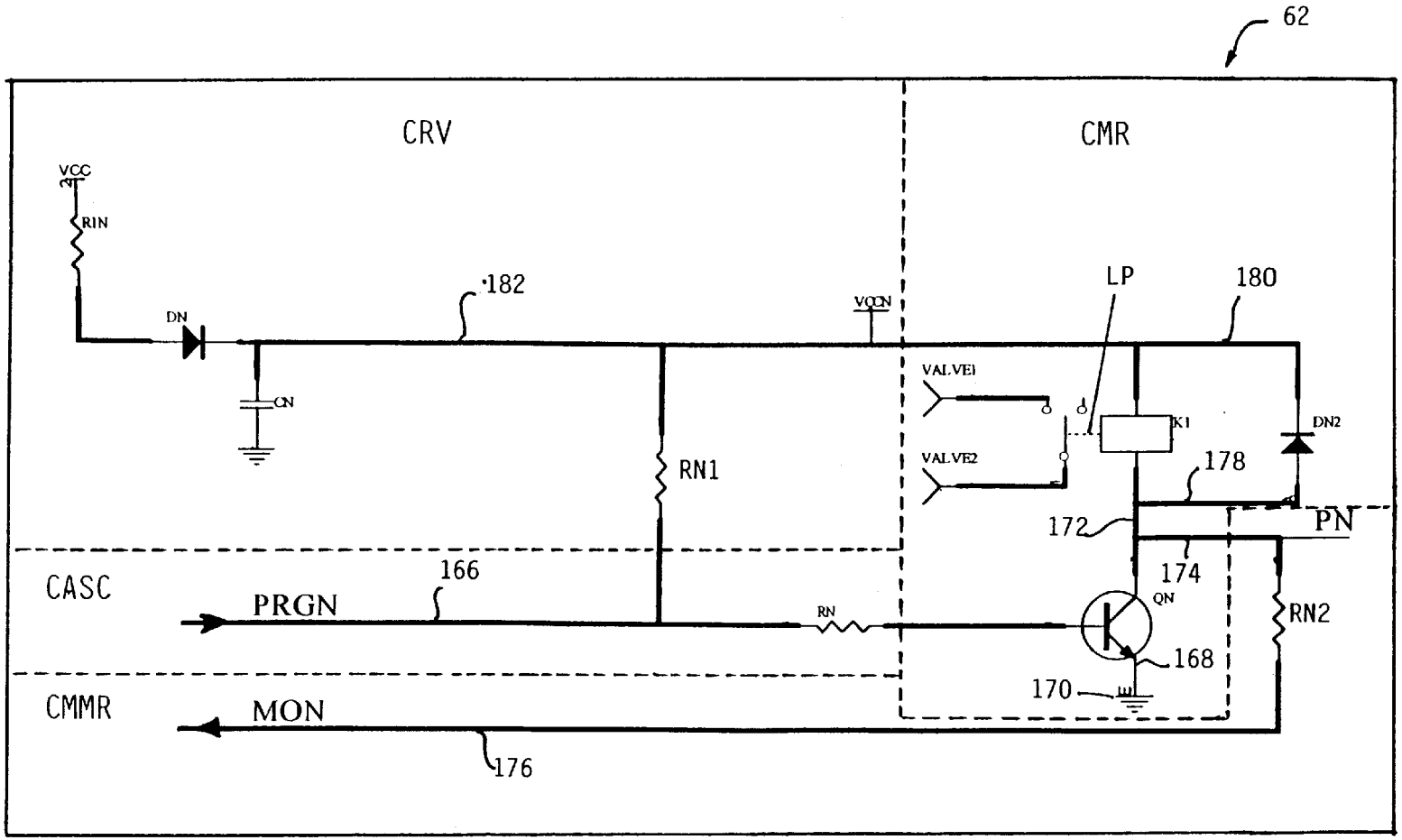

FIGS. 4, 5, and 6 show diverse embodiments of the electronic circuit 62, in order to implement it with the programmable burner of the present invention.

In a general manner, the electronic circuit 62, includes the following: a circuit for voltage backup CRV, connected to the feeding voltage VCC, of the clock 24, in order to store sufficient energy when there is a power failure and to be able to activate a relay operating circuit (CMR); the relay operating circuit (CMR) being utilized to open or close the thermocouple 18; a control signal conditioning circuit (CASC) receives the controlled signal that arrives to the micro controller 64, in order to control the relay operating circuit (CMR) in a logical manner.

The electronic circuit 62 includes, additionally, a monitoring circuit of relay (CMMR) that monitors the relay operating circuit (CMR) for the operation of thermocouple 18.

First Embodiment of the Electronic Circuit (62)

Now, making particular reference to FIG. 4, a first embodiment of the electronic circuit 62, is shown; it operates two control signals that originate from the micro controller 64.

When the user selects the time operation programming of the burner 10, the signal SLEEP IN is activated by the microprocessor 64. This signal directly polarizes the transistor Q102 through the diode DY and a resistor RY, that are connected in a series that permits the flow of current from the transistor Q102 to a ground 74. An exit line 74, of the transistor Q102 is connected to a ground 76 and the other exit line 78, of the transistor Q102 is connected to one of the exit lines of the transistor Q101.

The signal SLEEP is activated by the micro controller 64, at the time the regressive countdown of the operation time of the burner 10, starts, and this permits the transistor Q101, to be activated through the diode DX, and the resistor RX, that are connected in a series.

When both two signals SLEEP IN and SLEEP are activated in this circuit, to select the programming time and to start the regressive countdown, the circuit is prepared to generate a pulse that activates the coil of the relay K1. Because of this, both of these signals act under an function "AND", generated by the transistors Q101 and Q102.

The exit line 80, of the transistor Q101 is connected in a series with another resistor R101, which itself is connected to the current feeding line 82, that comes from the clock 24, through the voltage VCC.

A line 84, is connected between the transistor Q101 and the resistor R101, which is divided into line 86, and line 88. A resistor R102, is connected in a series with line 88, which itself is connected to the transistor Q103. Line 86 is connected, in a series, to a resistor R100, which itself is connected to the transistor Q104.

With respect to the transistor Q103, an exit line 90, is connected to the current feeding line 82, and the other exit line 92, is connected, in a series, with a resistor, R103, and a capacitor C111, both of which are connected to a ground 94. Between the resistor R103, and the capacitor C111, the line 96 is connected in a series with resistor R104, which itself is connected to an exit line 98, of transistor Q104. The other exit line 100 is connected to the base 102 of the transistor Q105. Again, a first exit line 104, of transistor Q105, is connected to ground line 106, while the other exit line 108, is connected to relay K1. A diode DR, is connected in parallel to the coil of the relay K1 through lines 110 and 112. The line 112 itself is connected to the current feeding line 82. The diode DR is utilized to discharge the coil of the relay K1, when its energy is removed through the transistor Q105. Circuit 62 shows a first connector VALVE1, which is connected to line 26 of valve 14, and a second connector VALVE2, that is connected to line 22 of the thermocouple 18. The dotted line LP, represents the contacts that activate or disconnect the relay K1.

In this manner, when transistors Q101 and Q102 are activated, resistors R101, R102 and R100 are grounded. Resistor 101 provides polarization current to transistors Ql01 and Q102 for their operation upon being grounded. When R102 is grounded, transistor Q103 is directly polarized, charging capacitor C111, through resistor R103.

At the same time, when resistor R100 is grounded, transistor Q104 is maintained open (in cut) thus preventing the discharge of capacitor C111 of the resistor R104 towards the transistor Q105, and consequently this transistor Q105, is maintained open, preventing the activation of the relay K1, which is maintained in its normally closed position, permitting the passage of the current from thermocouple 18, towards solenoid 56.

When the regressive countdown comes to zero, the signal SLEEP is disconnected, and therefore this transistor Q101 opens. This results in the ground line disconnection of resistor R100 directly polarizing transistor Q104, through resistors R101 and R100, that closes, discharging the capacitor C111 through resistor R104 towards transistor Q105, which is directly polarized, closing and permitting the activation of the relay K1.

When the relay K1 is activated, the passage of current of the thermocouple 18, towards the solenoid 56, of valve 14 is impeded, closing the passage of current and therefore the passage of gas.

The disconnection of the current that goes to the thermocouple 18, is only momentary, since the capacitor C111 has a discharge time, which arrives at a zero voltage, thus not polarizing the transistor Q105. Therefore, transistor Q105 is opened and the relay K1 is disconnected, leaving, again, the thermocouple 18, in the conduction position.

In the same way, when the programming time of the clock 24 is cancelled, the signal SLEEP IN is deactivated, provoking the same effect produced by the signal SLEEP when it is deactivated, thus energizing the relay K1 for an instant and opening the passage of current from the thermocouple 18, to the solenoid 56 of valve 14.

The electronic circuit, 62, in accordance with this first embodiment is coupled to the feeding voltage VCC of clock 24, by means of resistor R112 and a diode DP, which charge capacitor C110. The resistor R112, limits the current in order not to charge the capacitor C110, in a rapid manner and in order not to damage the voltage supply VCC.

When the feeding power for the clock 24, that generates the voltage VCC is interrupted, the voltage VCC drops to 0 volts. However, the voltage VCC1 provided by the capacitor C110 does not drop because it is prevented by the diode DP. This capacitor C110, is connected to a ground line 114, through line 116.

When the voltage VCC that goes to the clock 24, drops to 0 volts, the signals SLEEP and SLEEP IN are also deactivated provoking the same effect produced by the signals SLEEP or SLEEP IN when they are deactivated in a normal manner, energizing the relay K1, for an instant and opening the current of the thermocouple 18, to the solenoid 56 of valve 14.

This permits that when there is an involuntary power failure in clock 24, —which is already programmed—and the programming time is lost, there is not enough current for the activation of the relay K1 even if the clock 24, is not energized, since the capacitor, C110, would provide it, thus preventing an erroneous programming time.

When the feeding of power to the clock 24, that generates the current VCC is disconnected, the voltage VCC drops or goes down to 0 volts; however, the VCC1 voltage that is provided by the capacitor C110 does not, since the latter is being prevented by the diode DP.

Second Embodiment of the Electronic Circuit (62)

The circuit 62 of the second embodiment as is illustrated in FIG. 5, also handles two control signals, which are originated from the micro controller 64 of the clock 24.

In this case, the signal SLEEP IN is activated by the micro controller 64, when the user selects the operation time programming of the burner 10.

For this embodiment, the circuit 62 is constituted by a line 118, which receives the signal SLEEP, and it is connected to an inverter U2D. A resistor R14 is connected between the entry signal SLEEP and the inverter U2D through line 119, which itself is connected to ground 121. From the inverter U2, line 120 comes out, and is connected to the exit of the diode D19 in order to polarize it inversely. The entry connection of the diode D19 is connected to line 122, which divides into two lines 124 and 126. A resistor R13, is connected in a series to line 124, which itself is connected through line 128 to the power feeding line 130. On the other hand, line 126, is connected in a series with the capacitor C10, which is connected, at a point PA, that coincides with line 132 of the signal SLEEP IN. The point PA is connected in a series with a diode D16, which itself is connected to ground 134.

Line 126 is connected in a series with a diode D16, which itself is connected to a ground 134.

Line 132 of the signal SLEEP IN is connected in a series with a first diode D13, polarizing the diode D13 inversely, thus permitting the point PA to float. A second diode D15 is connected in a series with the diode D13, through line 136. The exit of diode D15 is connected through line 138 to the base of the transistor Q3, in order to directly polarize said transistor Q3. Between diode D15, and the transistor Q3, line 140 is connected in parallel, and this line is connected to a resistor R16, which, through a signal RET directly polarizes the transistor Q3. An exit 142, of the transistor Q3 is connected to a ground 144, and the other exit 146, is connected through line 148, to the relay K1 and interrupts the current of thermocouple 18.

As in the first embodiment, a diode D14, is connected in parallel to the coil of the relay K1 through lines 150 and 152. Line 152 is itself, connected to power feeding line 130. Diode D14 is utilized for discharging the coil of the relay K1 that is de-energized through the transistor Q3. Circuit 62 shows a first connector VALVE1 which is connected to line 26 of the valve 14, and a second connector VALVE2 which is connected with line 22 of the thermocouple 18. The dotted line LP represents the contacts that activate or deactivate the relay K1.

Circuit 62 is connected to the feeding voltage VCC through line 130 to the resistor R12 and to diode D11 which charges a capacitor C7, which stores sufficient energy to activate the relay K1 for a moment and to disconnect the current that comes from the thermocouple 18, turning off the burner 10, when the energy that feeds clock 24 is disconnected. A line 154, that is connected in parallel with line 130, and said line 154 includes, in a series, the diode D12, the resistor R15, to be finally connected to the transistor Q4. A capacitor C9, is connected in parallel with the resistor 15.

The first exit 156 of transistor Q4 is connected with line 130. Through the other exit 158, of the transistor Q4, the signal RET is generated and it directly polarizes the transistor Q3. A capacitor C8 that is connected by means of line 160, generates the signal RET so that the transistor Q3 is polarized through the resistor R16. The capacitor C8 is connected to a ground 162, through line 164.

In this manner, when the programming time of the clock 14, has not been selected, the signal SLEEP IN activates the diode D13, thus causing the point PA of the circuit to be found virtually connected to ground. This causes the transistor Q3 not to be polarized because its base it is connected to ground.

On the other hand, when the programming of time in the clock 14, has been selected, the signal SLEEP IN carries the voltage VCC to diode 13, polarizing it inversely, allowing the point PA to float.

When the point PA floats, the capacitor C10 may be charged through the resistor 13, and by means of the diode D15 in order to directly polarize the transistor Q3 to energize the relay K1 and interrupt the current of thermocouple 18, that feeds the solenoid 56 of valve 14, turning off burner 10.

At the moment that the programming time for the burner 10 is selected, at clock 24, the signal SLEEP IN is activated permitting the point PA to float, as was previously was described. At the same time, the signal SLEEP is activated causing the inverter U2D (that can also be a transistor or electronic interrupter) to have an exit to ground and thus polarize the diode D19 directly, preventing the charge to the capacitor C10, since it is short circuited through diode D19, the inverter U2D, the diode D16 and ground, preventing the direct polarization of transistor Q3, which does not energize the relay K1.

When regressive count down reaches zero, the signal SLEEP is deactivated, causing the inverter U2D to exit to a voltage level VCC1, which inversely polarizes the diode D19.

This permits the capacitor C10, to be charged through resistor R13, diode D15 and transistor Q3, with the transistor Q3 directly polarized in order to energize the relay K1 and interrupt the current to thermocouple 5, turning off the burner 10.

The relay K1 will be activated only during the charge time of capacitor C10, the relay K1 being deactivated after this time, leaving burner 10 capable of be ignited again.

In the same manner of embodiment 1, the circuit of embodiment 2 is connected to the feed voltage VCC through the resistor R12 and a diode D11 that charges a capacitor C7, which stores sufficient energy to activate the relay K1 for a moment and disconnect the current at the thermocouple 18, turning off the burner 10 when the current that energizes clock 24 is disconnected.

When this happens, the transistor Q4 is directly polarized through the resistor R15, the capacitor C9 and the diode D12, which is directly polarized due to the fact that the feed voltage VCC of clock 14 is less than the voltage VCC1.

In this condition the transistor Q4, which is in the status of conduction, provides power to the capacitor C8, which on its own, generates the signal RET so that the transistor Q3 is directly polarized through the resistor R16, directly conducting it and permitting the activation of the relay K1, turning off the burner 10. At the same time, the signal RET is connected to the clock circuit (not shown) to indicate that a power failure has taken place.

Third Embodiment of the Electronic Circuit (62)

In the third embodiment of the circuit 62 (FIG. 6), a control signal that comes from the micro controller 64 of clock 24 is activated, and it generates another signal towards the micro controller 64.

In this case, the circuit 62 generates a signal PRGN which is sent through line 166, and a resistor RN, which is connected in a series. The base of the transistor QN is connected in a series with the resistor RN. An exit line 168, of the transistor QN is connected to a ground 170. The other exit line 172, is connected to the relay K1. From line 172, line 174 is derived to take it through the point PN to ground. Line 174 also includes the resistor RN2 to obtain a signal MON through line 176, which is taken to the micro controller 64 to indicate that the transistor QN functions correctly. A diode DN2 is connected in parallel to the relay K1 through lines 178 and 180. Line 180 is itself connected with the power feeding line 182. The diode DN2 is utilized for discharging the coil of the relay K1 when it is de-energized through the transistor QN. Circuit 62 shows a first connector VALVE1, which is connected to line 26 of valve 14, and, a second connector VALVE2 that is connected to line 22 of the thermocouple 18. The dotted line LP, represents the contacts, which activate or deactivate the relay K1. A resistor RN1 is connected in parallel between the feeding line 182 and line 166, which serves as a support for polarizing the transistor QN.

Through this embodiment the signal PRGN is activated by the micro controller 64 when the programmed time of operation of burner 10 has arrived at zero, which directly polarizes the transistor QN through the resistors RN and RN1, which energizes the relay K1 interrupting the current to thermocouple 18 and closing the burner 10 during a time defined in the programming of the micro controller 64.

The signal MON is obtained from the transistor QN and from the resistor RN2 and it is taken to the micro controller 64 to indicate that the transistor QN functions correctly. That is to say, when the micro controller 64 generates the disconnecting pulse of the thermocouple 18, the transistor QN goes into the conduction status taking the point PN to ground. When the signal MON is connected to the point PN, the micro controller 64 will detect that the transistor QN was correctly polarized and connected the point PN to ground. If this does not take place, the micro controller 64 will generate an error signal to indicate that this transistor QN does not function correctly.

In this third embodiment, circuit 62 is connected to the feed voltage VCC of clock 24 through the resistor R1N and the diode DN, charging the capacitor CN, which stores sufficient charge for feeding the relay K1 if the feeding power VCC of the clock 24, disconnects.

If a power failure takes place, the micro controller 64 will detect the lack of line cycles, thus generating the signal PRGN to energize the relay K1 and close burner 10 with the power of the CN.

When the feeding energy of clock 24 that generates the voltage VCC is disconnected, the voltage VCC drops to 0 volts; however, the voltage VCCN provided by the capacitor CN is not prevented since this is prevented by the diode DN.

Even though several specific embodiments of a programmed burner have been described in the present invention, it should be understood that the experts in the field may make changes of design as well as changes in the placements of its parts, in keeping with the displays of the present invention, which, however, will be understood to be included in the true spirit and scope of the invention which is asserted in the following claims.

We claim:

1. A programmable burner for gas stoves which comprises:

a gas burner;

a safety valve including a thermocouple located in coincidence with an external edge of the burner, the safety valve being maintained open when the thermocouple is detecting the presence of a flame on the gas burner, and the safety valve being maintained in a closing position when the burner has been turned off;

an electrode placed near of the external periphery of the burner for igniting;

a spark generation module connected with the electrode for generating the sparks that are necessary for igniting the burner;

a spark interrupter connected to the spark generation module in order to activate or deactivate the spark generation in the spark generation module;

a programmable device, connected with the thermocouple and the safety valve, for programming the ignition time of the burner in accordance with a pre-established operation time by a user, wherein the programmable device comprises:

a controller;

a numbers display;

a keyboard for programming the ignition time of the burner;

a buzzer for generating an audible signal of the finishing of the programmed ignition time; and an electronic circuit to operate the burner in accordance with the programmed ignition time in the controller, wherein the electronic circuit to operate the burner in accordance with the programmed ignition time in the controller comprises:

a voltage backup circuit connected to the programmable circuit in order to store sufficient energy when there is a power failure and to be able to activate a relay operating circuit; the relay operating circuit being utilized to open or close the thermocouple; and a control signal conditioning circuit for receiving the controlled signal that arrives from the micro controller, in order to control the relay operating circuit;

wherein the control signal conditioning circuit comprises:

a first reception line for receiving an activating signal, which is activated by the controller when the user selects the programmed ignition time for the operation of the burner;

a second reception line for receiving an activating signal;

a first diode connected to the first reception line for generating a first activating signal;

a first resistor connected in series with the first diode;

a first transistor connected in series with the first resistor, the first transistor being polarized by the first diode and the first resistor;

a second diode connected to the second reception line for generating a second activating signal;

a second resistor connected in series with the second diode;

a second transistor connected in series with the second resistor, the second transistor being polarized by both second diode and the second resistor, the second transistor being further connected with the first transistor, with the first reception line, and with the second reception line, the first and second reception lines being activated to generate activating pulses by means of the first transistor and the second transistor;

a third resistor connected by an end to the second transistor and by the other end to a current feeding line of the voltage backup circuit;

a fourth resistor connected in parallel between the third resistor and the second transistor;

a third transistor, a base of the third transistor being connected in series with the fourth resistor, a first exit line of the third transistor being connected to a current feeding line of the voltage backup circuit;

a fifth resistor connected to a second exit line of the third transistor;

a first capacitor connected in series by a first end to the fifth resistor and by the other end connected to ground, so that when the fifth resistor is connected to ground, the third transistor is directly polarized and the first capacitor is charged by means of the fifth resistor;

a sixth resistor connected with the fifth resistor and the first capacitor;

a fourth transistor, a first exit of the fourth transistor being connected in series with the sixth resistor; and a seventh resistor connected by a first end to a base of the fourth transistor, the seventh resistor being connected in parallel by the opposed end, between the third resistor and the second resistor, the arrangement of the capacitors, transistors and resistors being utilized for receiving the control signals that are received by the controller.

2. The programmable burner for gas stoves as claimed in claim 1, wherein the programmable burner further comprises:

a programmable device interrupter connected to the programmable device, the safety valve, and the thermocouple, so that the burner may be operated under a programmed ignition time or under a normal operation.

3. The programmable burner for gas stoves as claimed in claim 1, wherein the electronic circuit to operate the burner in accordance with the programmed ignition time in the controller further comprises:

a monitoring circuit for the relay operating circuit for monitoring the relay operating circuit for the operation of the thermocouple.

4. The programmable burner for gas stoves as claimed in claim 1, wherein the control signal conditioning circuit further comprises:

a feeding line connected to the voltage backup circuit, the activating signal being activated by the controller when the programmed ignition time for the burner operation has dropped to zero, to close the burner in accordance with the programmed ignition time in the controller.

5. The programmable burner for gas stoves as claimed in claim 1, wherein the voltage backup circuit comprises:

a current feeding line;

an eighth resistor connected in series with the current feeding line;

a third diode connected in series with the eighth resistor; and a second capacitor connected by a first end, in parallel, with the current feeding line, the voltage of the second capacitor being limited by the eighth resistor and the third diode;

wherein the eighth resistor, third diode, and second capacitor are utilized to store energy when a loss of energy is detected and for activating the relay operating circuit.

6. A programmable burner for gas stoves which comprises:

a gas burner;

a safety valve including a thermocouple located in coincidence with an external edge of the burner, the safety valve being maintained open when the thermocouple is detecting the presence of a flame on the gas burner, and the safety valve being maintained in a closing position when the burner has been turned off;

an electrode placed near of the external periphery of the burner for igniting;

a spark generation module connected with the electrode for generating the sparks that are necessary for igniting the burner;

a spark interrupter connected to the spark generation module in order to activate or deactivate the spark generation in the spark generation module;

a programmable device, connected with the thermocouple and the safety valve, for programming the ignition time of the burner in accordance with a pre-established operation time by a user, wherein the programmable device comprises:

a controller;

a numbers display;

a keyboard for programming the ignition time of the burner;

a buzzer for generating an audible signal of the finishing of the programmed ignition time; and an electronic circuit to operate the burner in accordance with the programmed ignition time in the controller, wherein the electronic circuit to operate the burner in accordance with the programmed ignition time in the controller comprises:

a voltage backup circuit connected to the programmable circuit in order to store sufficient energy when there is a power failure and to be able to activate a relay operating circuit; the relay operating circuit being utilized to open or close the thermocouple; and a control signal conditioning circuit for receiving the controlled signal that arrives from the micro controller, in order to control the relay operating circuit;

wherein the control signal conditioning circuit comprises:

a first reception line for receiving an activating signal, which is activated by the controller when the user selects the programmed ignition time for the operation of the burner;

a second reception line for receiving an activating signal;

an inverter connected in series with the second reception line;

a first resistor connected between the inverter and a ground;

a first diode connected in series with the inverter, in order to polarize the first diode inversely;

a second resistor connected with the first diode, a first end of the second resistor being connected with a current feeding line of the voltage backup circuit and by the other end is connected in series with a first capacitor, an exit line of the first capacitor being in coincidence with the first reception line at a coincidence point;

a second diode connected in series with the capacitor, the second diode having an exit to a ground;

a third diode connected in series to the first reception line of activating signal, the third diode being inversely polarized;

a fourth diode connected in series with the third diode; and, a third resistor being connected by a first end, in series, with the voltage backup circuit and by the other end, between the fourth diode and an entry of the relay operating circuit;

wherein the first reception line, the third diode, the fourth diode are utilized for polarizing the relay operating circuit and the second reception line, the first diode, the inverter, the second diode being utilized to avoid the direct polarization of the relay operating circuit.

* * * * *